US012654221B2

(12) United States Patent
Kleinemeier

(10) Patent No.: US 12,654,221 B2
(45) Date of Patent: Jun. 16, 2026

(54) C-SHAPED TOOL HOLDER, SETTING DEVICE WITH THE C-SHAPED TOOL HOLDER AND METHOD FOR SETTING AN OFFSET DIFFERENCE OF THE C-SHAPED TOOL HOLDER

(71) Applicant: BÖLLHOFF VERBINDUNGSTECHNIK GmbH, Bielefeld (DE)

(72) Inventor: Andre Kleinemeier, Verl (DE)

(73) Assignee: Böllhoff Verbindungstechnik GmbH, Bielefeld (DE)

( * ) Notice: Subject to any disclaimer, the term of this patent is extended or adjusted under 35 U.S.C. 154(b) by 242 days.

(21) Appl. No.: 18/214,314

(22) Filed: Jun. 26, 2023

(65) Prior Publication Data

US 2023/0415222 A1 Dec. 28, 2023

(30) Foreign Application Priority Data

Jun. 27, 2022 (EP) ..... 22181365

(51) Int. Cl.
*B21J 15/30* (2006.01)
*B21J 15/36* (2006.01)

(52) U.S. Cl.
CPC ..... *B21J 15/30* (2013.01); *B21J 15/36* (2013.01)

(58) Field of Classification Search
CPC ..... B21D 28/14; B21D 39/03; B30B 15/044; B30B 15/047; B21J 15/025; B21J 15/10
See application file for complete search history.

(56) References Cited

U.S. PATENT DOCUMENTS 2,296,051 A * 9/1942 Pocock ..... B30B 15/044 100/231
3,561,252 A * 2/1971 Norton et al. ..... B30B 15/044 100/231
3,884,142 A * 5/1975 Jonsson ..... B30B 15/042 100/231
4,922,744 A * 5/1990 Stursberg ..... B30B 15/044 100/231

(Continued)

FOREIGN PATENT DOCUMENTS

DE 29818082 U1 12/1998
DE 102007020166 A1 10/2008

(Continued)

OTHER PUBLICATIONS

CN Office Action for CN Application No. 202310768722.0 dated Jan. 28, 2026 (8 pages).

*Primary Examiner* — Jason L Vaughan
(74) *Attorney, Agent, or Firm* — Reising Ethington P.C.

(57) ABSTRACT

A C-shaped tool holder has a first leg and a second leg that is arranged opposite to the first leg, a connecting piece by which the first leg and second leg are connected with each other at a respective connecting end. An operating end of the first leg serves for fastening a punch in the direction of the operating end of the second leg, and an operating end of the second leg serves for fastening a die dome wherein an offset difference due to a gravity-caused offset between the operating ends of the first and second legs can be minimized by at least one compensating element which is arranged at one or more of the following elements: the first leg, the second leg or the connecting piece.

17 Claims, 7 Drawing Sheets

(56) References Cited

U.S. PATENT DOCUMENTS

| | | | | |
|---|---|---|---|---|
| 5,060,362 | A * | 10/1991 | Birke | B21J 15/10 29/34 B |
| 6,073,525 | A * | 6/2000 | Edwards | B30B 15/22 83/859 |
| 7,971,335 | B2 * | 7/2011 | Opper | B21J 15/10 29/524.1 |
| 8,935,949 | B2 * | 1/2015 | Batt | B30B 15/044 100/231 |
| 2001/0030433 | A1 | 10/2001 | Stromberg et al. | |
| 2003/0173793 | A1 | 9/2003 | Stromberg et al. | |
| 2017/0095988 | A1 * | 4/2017 | Rauschenberger | B30B 15/14 |

FOREIGN PATENT DOCUMENTS

| | | | |
|---|---|---|---|
| DE | 102014109144 | A1 | 12/2015 |
| DE | 102019122982 | A1 | 3/2021 |
| EP | 1119439 | A1 | 8/2001 |
| KR | 1020140026817 | A | 3/2014 |
| SU | 631361 | A1 | 11/1978 |
| WO | WO0002701 | A1 | 1/2000 |

* cited by examiner

C-SHAPED TOOL HOLDER, SETTING DEVICE WITH THE C-SHAPED TOOL HOLDER AND METHOD FOR SETTING AN OFFSET DIFFERENCE OF THE C-SHAPED TOOL HOLDER

CROSS REFERENCE TO RELATED APPLICATIONS

This application claims the priority to EP Patent Application No. EP22181365.2 filed on Jun. 27, 2022, and the entire content of this priority application is incorporated herein by reference in its entirety.

TECHNICAL FIELD

The present disclosure relates to a C-shaped tool holder, a setting device with the C-shaped tool holder and a method for setting an offset difference of the C-shaped tool holder.

BACKGROUND

The use of C-shaped tool holders is generally known in the state of the art, e.g. with setting devices. Normally, a corresponding C-shaped tool holder comprises a frame structure defining a frame plane, and comprises two legs which are connected with each other by means of a connecting piece. In case of a setting device, a punch having a drive unit and a die dome is arranged at the free ends of the legs.

Increasing demands to such C-shaped tool holders in terms of preciseness and centricity or concentricity of the connection to be established delimit the tolerances in case of process-caused deformations. Such a process-caused deformation is for example bending open the C-shaped tool holder during the setting process.

For the centricity, it is not the absolute deformation of the C-shaped tool holder that is relevant in this context but that the C-shaped tool holder deforms such that punch and die meet at the point of operating or joining in a centrical or concentrical manner. In other words, the two legs of the C-shaped tool holder must deform equally. In this context, the operating or joining point is the contact point of punch and die with the components lying in between, wherein the component thicknesses are negligible in comparison with the total stroke of the setting device.

An example for decreasing such process-caused deformations can be found in DE 10 2007 020 166 A1. Here, a tool holder with mechanically active elements is described, which is for example used with plants for processes by technical forming, especially clinching and punch-riveting, as well as thermal joining processes such as resistance spot welding, handling processes, embossing processes, screwing and press-fit processes. The tool holder has a tool holding portion holding a tool which, when operated, has to be forced against a workpiece or the like with an operating force while elastically deforming the framework structure of the tool holder. An increased flexibility in use is provided by the fact that at the tool holder, especially detachable, mechanically active elements are provided that are active in or act upon an area of deformation, said active elements influencing, during the deformation, predetermined mechanical properties, especially deformation properties, of the tool holder in a predetermined manner. Accordingly, the mechanically active elements serve for acting against a process-caused deformation, i.e. a bending open of the C-shaped tool holder.

In modern applications, corresponding C-shaped tool holders are frequently used in combination with multi-axle robots. For this purpose, the C-shaped holder comprises either centrally in the portion of the connecting piece or adjacent to it at the first leg, i.e. at the top, a fastening portion for a binding unit for the binding to the multi-axle robot. With regard to the corresponding joining tasks, the C-shaped tool holder is therefore often arranged not exclusively vertical but also in an inclined or horizontal manner.

In the horizontal tool position, the C-shaped tool holder may deform itself due to its dead weight and the weight of the drive, which has a big influence on the centricity of the connection. Furthermore, there are different further disturbing factors such as for example a play in the guideways or also production tolerances and the material thickness of the C-shaped tool holder, which can lead to deflections from an ideal operating or joining point. This must also be taken into account due to the increasing requirements to setting devices.

Furthermore, it should be considered that standardized components are generally used in connection with a so-called modular principle in order to meet the challenges regarding costs, delivery times and effort in development. Frequently, there is only one ideal combination with one die dome and one punch with drive unit for each variant of the C-shaped tool holder within such modular systems for an exemplary setting device. In other words, each C-shaped tool holder comprises an ideal operating or joining point with given binding and given drive weight. The further the actual operating or joining point moves away from the ideal operating or joining point, the higher the eccentricity of the connection is. Therefore, all further combinations of the modular system usually have an eccentricity.

That means that the higher the requirements to the centricity, the fewer combinations can be realized with the modular system.

That means that for tools with which the standard modular system is not sufficient for fulfilling the requirements to centricity, individual specific solutions are developed. On the one hand, these include the production of more rigid C-shaped tool holders, which may have a broader frame structure. However, this leads to higher costs, a higher weight as well as a higher interfering contour resulting from that. This problem is alternatively solved by means of a special binding to, for example, a multi-axle robot. This does, however, also lead to higher costs and a higher weight so that same is expedient for only some combinations.

In summary it can therefore be said that a disadvantage of the known C-shaped tool holders is that the requirements to centricity delimits the combination possibilities of punch with drive unit and die and require the use of special constructions. The latter is accompanied by high costs in construction and production, long delivery times, higher storage costs as well as the corresponding replacement stocking and an increased effort in the general maintenance of parts.

Better properties with respect to centricity can often only be realized by means of a larger width of the C-shaped tool holder. This leads to higher costs in production due to the necessary raw material and the processing time, a higher interfering contour of the C-shaped tool holder, a higher self-weight and therefore to a higher overall weight, too. Due to the higher overall weight, a higher class of robots might have to be chosen when binding an exemplary setting device to a multi-axle robot, which additionally leads to higher costs. Furthermore, the additional self-weight leads to a higher deformation which counteracts the advantage of higher rigidity.

It is therefore the object of at least some implementations of the present disclosure to provide an alternative solution for a C-shaped tool holder which fulfils the requirements to centricity of the connection in combination with different drive units even in horizontal tool arrangement in a process-safe manner, thus overcoming the above disadvantages. In the same way, it is a task to provide a corresponding setting device and a method for setting an offset difference of the C-shaped tool holder.

SUMMARY

The above object is solved by a C-shaped tool holder, a setting device with the C-shaped tool holder as well as a method for setting an offset difference of the C-shaped tool holder. Advantageous embodiments and further developments result from the following description, the drawings as well as the appending claims.

A C-shaped tool holder with a frame structure defining a frame plane comprises a first leg and a second leg that is arranged opposite to the first leg, each leg including a connecting end and an operating end, a connecting piece by means of which the first leg and the second leg are connected with each other at the respective connecting end, wherein the operating end of the first leg serves for fastening a punch with an associated drive unit defining a movement direction of the punch in the direction of the operating end of the second leg, and the operating end of the second leg serves for fastening a die dome wherein an offset difference due to a gravity-caused offset between the operating end of the first and the operating end of the second leg perpendicular to the frame plane can be minimized by at least one compensating element which is arranged at one or more of the following elements: the first leg, the second leg or the connecting piece, and an intersecting point of a first straight line corresponding to the movement direction of the punch in the direction of the operating end of the second leg, and a second straight line extending from the operating end of the second leg in the direction of the operating end of the first leg, is settable to an operating point by means of the at least one compensating element.

In the following, the C-shaped tool holder is discussed when used in a setting device. For this purpose, the C-shaped tool holder may have a framework like frame structure. Due to the use in a setting device, a punch with an associated drive unit may be fastened at the operating end of the first leg and a die dome is fastened at the operating end of the second leg. A binding of the C-shaped tool holder to a multi-axle robot takes place for example by means of a central fastening portion for a binding unit. The binding unit is therefore provided centrally at the connecting piece.

First of all, a vertical tool position is assumed. In this vertical tool position, the frame plane extends parallel to gravity. In other words, the first straight line which corresponds to the movement direction of the punch in the direction of the operating end of the second leg, and the second straight line, are congruent. Therefore, the first and the second straight line extend exemplary along a first axis, namely the x-axis of a Cartesian coordinate system. The y-axis extends parallel to the first and the second leg. Therefore, the x and the y-axis constitute the frame plane defined by the frame structure.

When the corresponding setting device is now arranged in a horizontal position, the weight of the drive unit at the first leg leads to the operating end of the first leg being offset out of the frame plane due to gravity, i.e. along the z-axis. For that, the cantilever of the first leg in y-direction is essential, i.e. a length of the first leg or the distance between the operating end of the first leg and the binding unit along the y-axis. The same applies analogously to the operating end of the second leg with the die dome.

Due to the weight of the die dome that is lower compared to the drive unit, the gravity-caused offset for the operating end of the second leg is lower than the gravity-caused offset of the first leg. In other words, and when considering only this effect, the first and the second straight line extend parallel to each other but no longer in a congruent way. Thus, the gravity-caused offset difference arises between the operating end of the first and the operating end of the second leg, which needs to be compensated.

In addition, the cantilevers of the first and the second leg are to be taken into consideration which arise due to the exemplary central attachment along the x-axis, as these cantilevers lead to an angular offset apart from the gravity-caused offset, whereby the first straight line and the second straight line do no longer extend parallel to each other but meet at one intersecting point. This intersecting point does, however, not necessarily correspond to the operating point of the setting device so that here, a corresponding setting or correction is also necessary.

In order to compensate these effects, the at least one compensating element is provided. In the present example, the same is fastened to the first leg due to the higher gravity-caused offset, which may be in a releasable manner, e.g. by means of screws, pins, clamps or clips, as it may be the releasable kind of fastening which provides the possibility of considering the changed gravity-caused offset when using another punch with drive unit and/or another die dome. The C-shaped tool holder may include two compensating elements, which may be on opposite sides of the same element, i.e. here the first leg. In this way, the deformation of the first leg is adapted to the deformation of the second leg in a way that the first and the second straight line meet or intersect at the operating point.

In case of an exemplary attachment of the tool holder to the multi-axle robot in the portion of the first leg, i.e. in case of an upper binding, the at least one compensating element may be arranged at least at the connecting piece. The reason for this are the cantilevers, which are changed due to the different binding, along the x-axis and the y-axis of the first and the second leg as well as the resulting changed deformation of the first and the second leg. With regard to the details, reference is made to the detailed description.

A general advantage of this approach is that a subsequent setting of the eccentricity of a standardized modular tool in the form of a C-shaped tool holder can be implemented. Therefore, the at least one compensating element may be fastenable variably to one of the following elements: first leg, second leg or connecting piece. It is advantageous that a compensation of the play of the downholder in the exemplary setting device can be realized in this way.

With the possibility of setting that has been realized in this way, the centricity for a plurality of combinations of die dome and C-shaped tool holder can additionally be set individually. Thus, the use of a modular system is still possible, wherein compared with the state of the art, additional combinations of punch with drive unit and die dome can be implemented.

Furthermore, the C-shaped tool holders can be less rigid and the dead weight of the C-shaped tool holder can be reduced. In addition, this means that the width of the C-shaped tool holders can be reduced which leads to a reduction of the interfering contour, too. Furthermore, this has a positive effect on the manufacturing costs as they are also reduced in case of a reduced width of the C-shaped tool holder.

According to a further embodiment of the C-shaped tool holder, the at least one compensating element has in cross section a first axial geometrical moment of inertia and a second axial geometrical moment of inertia that is larger than the first axial geometrical moment of inertia, and the at least one compensating element is arranged so that the second axial geometrical moment of inertia acts perpendicularly to the frame plane. With the axial geometrical moment of inertia, the cross-sectional dependency of the distortion of the at least one compensating element when loaded is considered. In this context, the distortion of the at least one compensating element is the smaller the larger the axial geometrical moment of inertia is. For this reason, the at least one compensating element is arranged to one of the elements first leg, second leg or connecting piece in a way that gravity causes the lower distortion. Therefore, the higher axial geometrical moment of inertia acts perpendicularly to the frame plane. For the better comprehensibility, this approach is explained based on a compensating element which is rectangular in cross section. In cross section, its height h is larger than its width b.

In a first case, this rectangular compensating element is for example arranged at the first leg such that the height h extends parallel to the x-axis of the initially defined Cartesian coordinate system and thus to the frame plane. Accordingly, the width b extends parallel to the z-axis, i.e. out of the frame plane. In case of a distortion around an axis parallel to the x-axis, i.e. in case of a gravity-induced distortion, the axial geometrical moment of inertia of the compensating element is therefore calculated as follows:

$$\frac{h \cdot b^3}{12}.$$

In the second case, the compensating element is exemplary arranged at the first leg such that the width b extends parallel to the x-axis, now causing the height h to extend beyond the z-axis out of the frame plane. The axial geometrical moment of inertia in case of a distortion around an axis parallel to the x-axis, i.e. in case of a gravity-induced distortion, is now calculated as follows:

$$\frac{b \cdot h^3}{12}.$$

Only in this second case, as the height h is larger than the width b, the larger axial geometrical moment of inertia acts perpendicularly to the frame plane. In the first case, the larger geometrical moment of inertia acts to the frame plane, namely in case of a distortion around an axis parallel to the z-axis.

Due to this alignment of the compensating element, the at least one compensating element may have such a stiffening effect on, for example, the first leg so that the offset difference between the first and the second leg may be minimized and the intersecting point between the first and the second straight line corresponds to the operating point of the exemplary setting device.

The compensating element may have a profile shape having one of the following shapes in cross section: rectangle, semi-circle, circular layer or circular zone, triangle, T-shape, double-T-shape, L-shape, U-shape, trapezoid or a combination thereof. These shapes have a high axial geometrical moment of inertia in one direction. Therefore, the disclosure may be realized advantageously with these shapes.

In a further advantageous embodiment of the C-shaped tool holder, the at least one compensating element includes at least two fastening points, which may be at least four, six, eight or ten fastening points and which may be a plurality of fastening points. When using a plurality of fastening points, starting off with four fastening points, two fastening points, each may be located directly next to each other, e.g. at an end of the at least one compensating element. Due to the use of two fastening points each directly next to each other, an operating force induced bending-open of the C-shaped tool holder can furthermore be counteracted.

The compensating element may have the shape of a hollow profile or bowl profile and furthermore, two slot nuts are present between the compensating element and the first leg, the second leg or the connecting piece. On the one hand, the slot nuts prevent a deformation of the at least one compensating element, thus losing its positive properties. On the other hand, the geometrical moment of inertia can be influenced further by dimensioning the slot nuts. In this context, reference is made to the parallel axis theorem/Steiner's theorem. Apart from that, this will be made clearer later with reference to the detailed description and the figures.

A setting device includes a C-shaped tool holder, with a punch with an associated drive unit being fastened at the operating end of the first leg and a die dome being fastened at the operating end of the second leg. A corresponding setting device has been discussed already in detail in the discussion regarding the C-shaped tool holder. In order to avoid unnecessary repetitions, reference is therefore made to the corresponding explanations regarding the technical effects and advantages.

Advantageously, the setting device is fastened to the multi-axle robot by means of the C-shaped tool holder. In this way, the setting device can be used in different orientations, e.g. in an automated production line.

A method for setting an offset difference between a first and a second leg of a C-shaped tool holder includes the steps: arranging the C-shaped tool holder in a way that a frame plane is aligned perpendicular to gravity, after that, determining a first offset of the first leg with respect to the frame plane and determining a second offset of the second leg with respect to the frame plane, after that, fastening at least one compensating element to one or more of the following: the first leg, the second leg or the connecting piece, and minimizing an offset difference between the operating end of the first and the operating end of the second leg. With respect to the method, too, reference is made to the above statements regarding the C-shaped tool holder, which may be with respect to the arising technical effects and advantages.

In one advantageous embodiment, the method includes the further step: setting an intersecting point of a first straight line, which corresponds to a direction of movement of the punch in the direction of the operating end of the second leg, and of a second straight line, which extends from the operating end of the second leg in the direction of the operating end of the first leg, by means of the at least one compensating element to an operating point. With this step, not only the gravity-caused offset difference is taken into consideration but also the present angular offset.

In cross section, the at least one compensating element comprises a first axial geometrical moment of inertia and a second axial geometrical moment of inertia that may be bigger than the first axial geometrical moment of inertia, and the step of fastening takes place such that the compensating element is arranged in a way that the second axial geometrical moment of inertia acts perpendicularly to the frame plane. This approach causes a reinforcement of the respective element to which the at least one compensating element is arranged, and by doing so, realizes the compensation of the offset difference and sets the intersecting point of the first and the second straight line to the operating point. With regard to that, additional reference is made to the corresponding above discussion of the embodiment of the C-shaped tool holder and the associated example of the compensating element that may be rectangular in cross section.

Furthermore, it is advantageous that the at least one compensating element is fastened via at least two fastening points to one or more of the following elements: the first leg, the second leg or the connecting piece. When using a plurality of fastening points, starting off with four fastening points, an operating force induced bending-open of the C-shaped tool holder can be considered and may be minimized.

In a further embodiment of the method, the at least one compensating element may be releasably fastened to the first leg, the second leg or the connecting piece, which may be by means of screws, pins, clamps or clips. The releasable fastening which may allow the tool holder to adapt to different punches with drive unit and die domes, as by that, an adaption to the respective weight is possible. Thus, the modular principle continues to be applicable.

Finally, the at least one compensating element advantageously has the shape of a hollow profile or a bowl profile and at least two slot nuts are present between the compensating element and the first leg, the second leg or the connecting piece. As shown above, on the one hand, the slot nuts hinder the at least one compensating element from being deformed and thus losing its positive properties when being fastened. On the other hand, the geometrical moment of inertia can be further influenced by means of the dimensioning of the slot nuts.

BRIEF DESCRIPTION OF THE DRAWINGS

In the following, the present disclosure will be described in detail based on the drawings. In the drawings, the same reference signs denote the same components and/or elements. They show.

DETAILED DESCRIPTION

Figure 1:
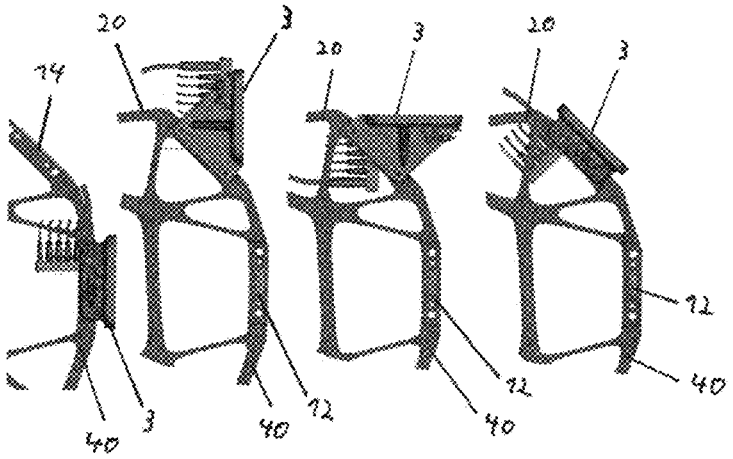
FIGS. 1A, 1B, 1C and 1D schematic views of different binding possibilities of a C-shaped tool holder to a multi-axle robot, FIG. 2 a schematic view of a special solution for binding a C-shaped tool holder to a multi-axle robot, FIG. 3 an illustration for clarifying the gravity-caused deformation of a C-shaped tool holder, FIG. 4 a schematic view for clarifying the gravity-caused offset in case of a horizontal position of the C-shaped tool holder, FIG. 5 a schematic view for clarifying the angular offset in case of a horizontal position of the C-shaped tool holder, FIG. 6 a schematic view of a first embodiment of a C-shaped tool holder when using a central binding as well as with a compensating element arranged to the first leg, FIG. 7 a view of the upper portion of the C-shaped tool holder according to FIG. 4 with alternative fastening points of the at least one compensating element, FIG. 8 a perspective view of the at least one compensating element, FIG. 9 shapes of profiles for the at least one compensating element in cross section, FIG. 10 the C-shaped tool holder according to FIG. 6 in an exploded view, FIG. 11 a view of the upper portion of the C-shaped tool holder according to FIG. 6 with further alternative fastening points of the at least one compensating element, FIG. 12 a sectional view along the line A-A of FIG. 11, FIG. 13 a schematic view of a second embodiment of the C-shaped tool holder when using the upper binding as well as with a compensating element arranged at the connecting piece and at the first leg, and FIG. 14 a schematic flow chart of an embodiment of a method for setting the offset difference.

In the following and with respect to FIGS. 1*a*, 1*b*, 1*c* and 1*d*, firstly, a section of a C-shaped tool holder 1 is shown in order to clarify the possible binding positions to a multi-axle robot. The C-shaped tool holder 1 has a framework-like frame structure 10. Furthermore, the C-shaped tool holder 1 comprises a first leg 20 and a second leg 30 arranged opposite to the first leg 20. The first leg 20 comprises an operating end 22 and a connecting end. In the same way, the second leg 30 comprises an operating end 32 and a connecting end. The first 20 and the second leg 30 are connected with each other at the connecting ends by means of a connecting piece 40. In the illustrations shown in FIGS. 1*a*-1*d*, the section comprises the connecting piece 40 as well as the portion of the first leg 20 with the connecting end.

For the better understanding of the further explanations, a vertical tool position is assumed, as is indicated in FIGS. 1*a*-1*d*. In this vertical tool position, the frame plane R extends parallel to gravity. In other words, a first straight line $G_1$, which corresponds to a direction of movement of a punch in the direction of the operating end of the second leg 30, and the second straight line $G_2$ are congruent. The first $G_1$ and the second straight line $G_2$ therefore exemplary extend along a first axis, namely the x-axis of a Cartesian coordinate system. The y-axis extends parallel to the first 20 and the second leg 30. The x and the y-axis therefore constitute the frame plane R which is defined by the frame structure 10 (also compare FIGS. 4 and 5).

As can be seen in FIGS. 1*a*-1*d*, the C-shaped tool holder 1 comprises a central fastening portion 12 in the portion of the connecting piece as well as an upper fastening portion 14 in the portion of the first leg 20. The upper fastening portion 14 in the portion of the first leg 20 may be aligned in a way that it includes an angle of 45° with the x-axis and therefore also with the y-axis. In use, a binding unit 3 for binding with the multi-axle robot is mounted to one of the fastening portions 12, 14.

From left to right, figure T a show a centrally mounted binding unit 3, whose binding surface to the multi-axle robot extends parallel to the x-axis as well as parallel to the z-axis of the Cartesian coordinate system. In the further three illustrations of FIGS. 1*b*-1*d*, the binding unit 3 is mounted at the upper fastening portion 14, with each binding surface being aligned differently. That means that the binding surface, as shown in FIG. 1*a*, can firstly extend parallel to the x and the z-axis. Alternatively, the binding surface can extend parallel to the y and to the z-axis. This is shown in FIG. 1*c*. In other words, and with respect to these two alignments of the binding surface, there is an angle of 45° between the upper fastening portion 14 and the binding surface. Finally, and with respect to FIG. 1*d*, the binding surface, just as the upper fastening portion 14, can enclose an angle of 45° both with the x as well as with the y-axis and can extend parallel to the z-axis.

Figure 2:
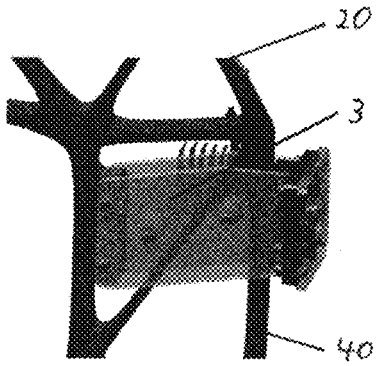

FIG. 2 shows a special solution of a binding unit 3. Here, the binding does not only take place at the outer part of the C-shaped tool holder 1 but extends in the portion of the connecting piece 40 over the width of the C-shaped tool holder 1.

Figure 3:
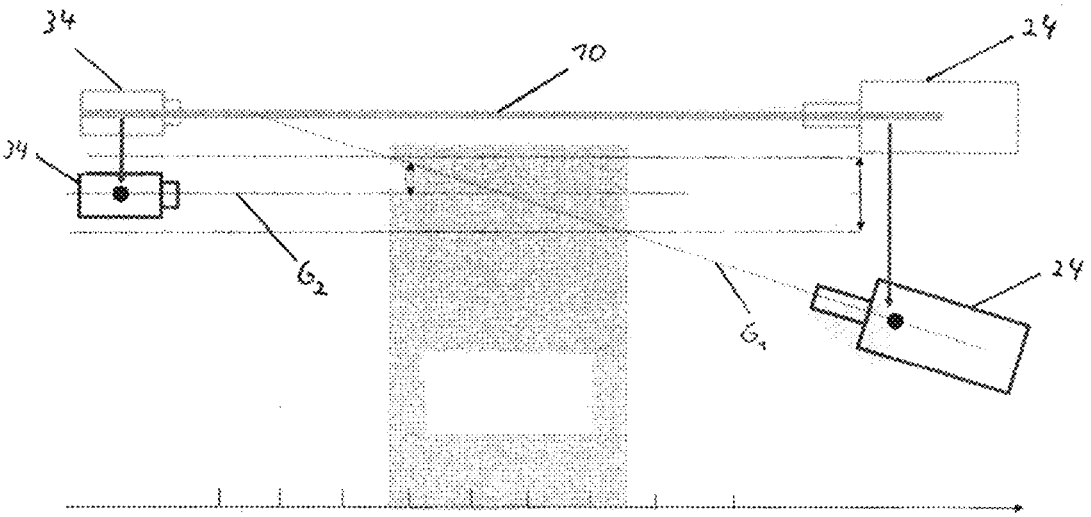
Figure 4:
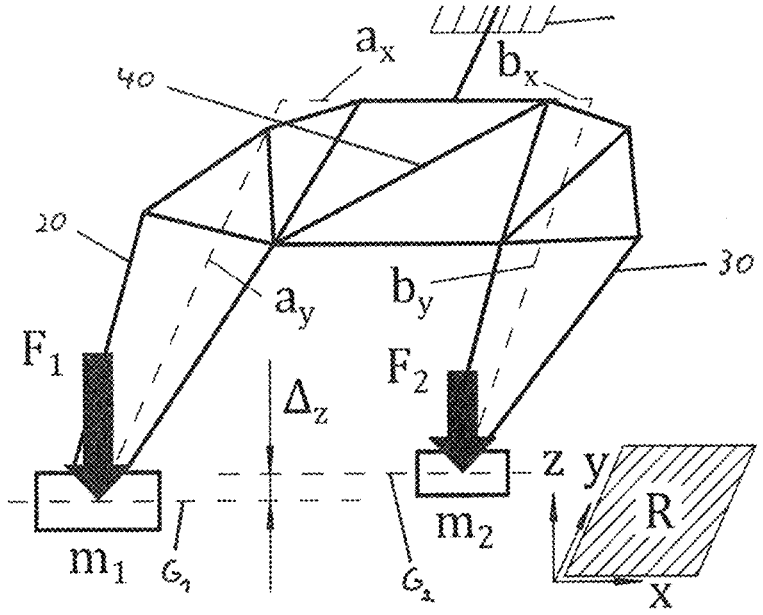
Figure 5:
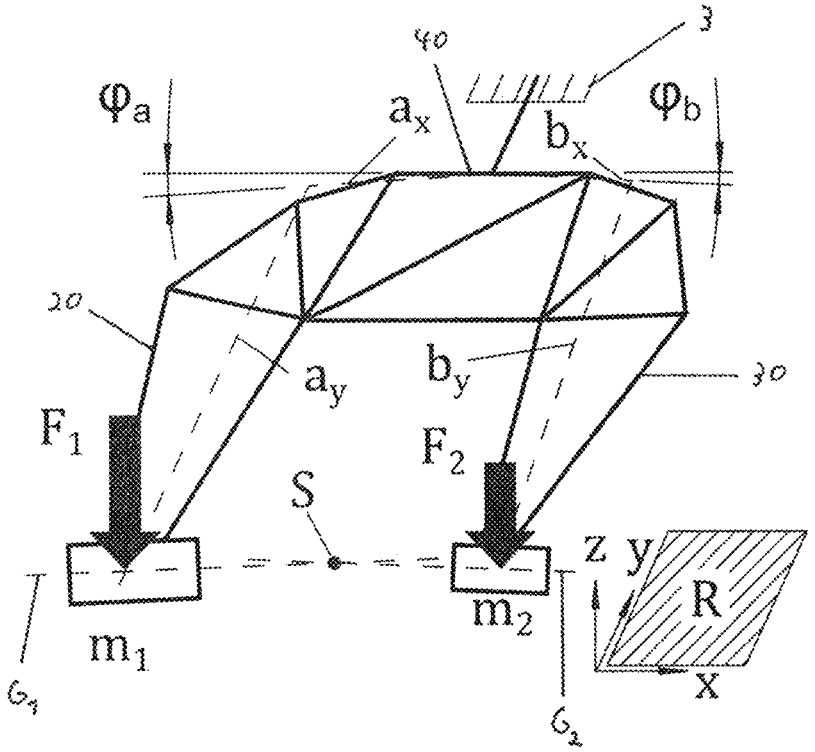

Now, with respect to FIGS. 3-5, the behavior of a C-shaped tool holder 1 when being used in a horizontal alignment is first of all explained in order to demonstrate the underlying problem.

For this purpose, the upper view of FIG. 3 schematically shows the C-shaped tool holder 1 with the punch with drive unit 24 at the first leg 20 and the die dome 34 at the second leg 30. In this example, the binding to the multi-axle robot takes place centrally at the C-shaped tool holder 1.

Due to the weight, which may be of the punch 24, with drive unit as well as of the die dome 34, same bend down with respect to FIG. 3, which is highlighted by means of the corresponding arrows. Likewise, for clarification, the resulting first $G_1$ and second straight line $G_2$ were drawn-in for showing the deformed state. As can be seen, the first straight line $G_1$ corresponds to the movement direction of the punch 24 in the direction of the die dome 34. The second straight line $G_2$ extends from the operating end of the second leg 30 in the direction of the operating end 22 of the first leg 20. For reasons of simplicity, it was assumed in FIG. 3 that the second straight line $G_2$ continues to extend parallel to the x-axis of the reference system, i.e. of the Cartesian coordinate system mentioned at the beginning.

The portion of permitted eccentricity is shown above and below the die dome 34 by means of the drawn-in lines. The intersecting point of the first straight line with this permitted portion provides an overview of the theoretically possible combinations of C-shaped tool holder 1 and size of the die dome 34 with the same punch 24 with drive unit.

The underlying aspects of this deformation/Underlying aspects caused by bending are now discussed with respect to the schematic FIGS. 4 and 5.

Both figures schematically show the C-shaped tool holder 1 where the binding unit 3 is bound centrally to the connecting piece 40. For orientation, the Cartesian coordinate system with x, y and z-axis is drawn in which is used in the application as the reference system.

The frame plane R which is defined by the frame structure 10 thus lies in the x, y-level, as shown at the beginning. Due to the horizontal arrangement of the C-shaped tool holder 1, the frame plane R therefore extends parallel to the ground.

The punch 24 with drive unit is provided at the operating end 22 of the first leg 20. It is marked as first mass $m_1$. The die dome 34 is provided at the operating end 32 of the second leg 30. It is marked as second mass $m_2$. The first mass $m_1$ is bigger than the mass $m_2$, so that the resulting first force $F_1$ at the operating end 22 of the first leg 20 is larger than the resulting second force $F_2$ at the operating end 32 of the second leg 30. This is illustrated both with the arrows at the forces $F_1$, $F_2$ as well as by the dimensioning of the boxes symbolizing the masses.

The distance to the binding unit 3 is relevant for the behavior of each leg 20, 30 at the operating end 22, 32, as the binding unit 3 depicts the fastening point. Schematically, each leg 20, 30 therefore turns into a first cantilever parallel to the x-axis and a second cantilever parallel to the y-axis. Thus, the first leg 20 comprises the cantilever $a_x$ in the x-direction or parallel to the x-axis, respectively, and the cantilever $a_y$ in the y-direction or parallel to the y-axis, respectively. In the same way, the second leg 30 comprises the cantilever $b_x$ in x-direction or parallel to the x-axis, respectively, and the cantilever $b_y$ in y-direction or parallel to the y-axis, respectively.

FIG. 4 serves for showing a first problem in case of a horizontal arrangement of the C-shaped tool holder 1, that is a possible difference regarding the offset of the operating ends 22, 32 perpendicular to the frame plane R, i.e. parallel to the z-axis. For this offset, the cantilever in y-direction, i.e. $a_y$ and $b_y$ is relevant. As in the illustrated example, the cantilevers $a_y$ and $b_y$ are the same, the different masses $m_1$ and $m_2$ and thus the differently sized acting first $F_1$ and second forces $F_2$ cause an offset difference $\Delta_z$ in z-direction or parallel to the z-axis, respectively, between the first leg 20 and the second leg 30. Thus, the first straight line $G_1$ and the second straight line $G_2$ are no longer aligned concentrically or centrically with each other. Rather, an eccentricity is present.

A corresponding deflection w can generally be calculated with the formula (1):

$$w = \frac{Fl^3}{3EI}$$

with F being the force, l being the length of the cantilever, E being the elasticity module and I being the geometrical moment of inertia of the leg cross section.

The second problem is made clear in FIG. 5, because apart from the offset difference $\Delta_z$, an angular offset φ occurs at the same time. This angular offset results from the cantilever $a_x$ of the first leg 20 in x-direction and the cantilever $b_x$ of the second leg 30 in x-direction. The corresponding angles of the first 20 and the second leg 30 are marked with $\varphi_a$ and $\varphi_b$. The angular offset $\varphi_a$ of the first leg 20 and the angular offset $\varphi_b$ of the second leg 30 cause the first straight line $G_1$ and the second straight line $G_2$ to meet at the intersecting point S, which, however, does not have to be the same as the operating point of the setting device. A deflection between intersecting point S and operating point does, however, lead to an eccentricity that has to be compensated.

Beside the deflection of the legs 20, 30, an inclination can therefore be observed at the same time, which results in an angular offset. The inclination φ can generally be calculated with the formula (2)

$$\varphi = \frac{Fl^2}{2EI}$$

with F being the force, l being the length of the cantilever, E being the elasticity module and I being the geometrical moment of inertia of the leg cross section.

Therefore, both the offset difference $\Delta_z$ should be minimized as well as the angular offset should be considered in order to realize an optimal working. Furthermore, the intersecting point S of the first straight line $G_1$ and the second straight line $G_2$ are set in a way that the two straight lines meet at the operating point, i.e. the intersecting point S corresponds to the operating point.

The deflections of the first 20 and of the second leg 30 are adjusted so that the offset or the offset difference $\Delta_z$, respectively, is the same or at least close to 0. Consequently, the requirement that the deflection of the first leg 20 and the deflection of the second leg 30 is approximately the same is fulfilled as far as possible.

The deflection of the first leg 20, that is marked with $w_a$ in the following, and the deflection of the second leg 30, that is marked with $w_b$ in the following, are each constituted of a component in x-direction and a component in y-direction, equivalent to the cantilevers. This results in formula (3) due to the application of the superposition:

$$w_a = \frac{F_1 a_y^3}{3EI_a} + \frac{F_1 a_x^3}{3EI_a} \cong \frac{F_2 b_y^3}{3EI_b} + \frac{F_2 b_x^3}{3EI_b} = w_b.$$

The inclination φ of the first and the second leg 20, 30 with respect to the x-direction causes, as explained above, the first straight line $G_1$ and the second straight line $G_2$ to meet at the intersecting point S. The angular offset is negligibly small regarding the deflections, it is, however, important for the intersecting point S.

Figure 6:
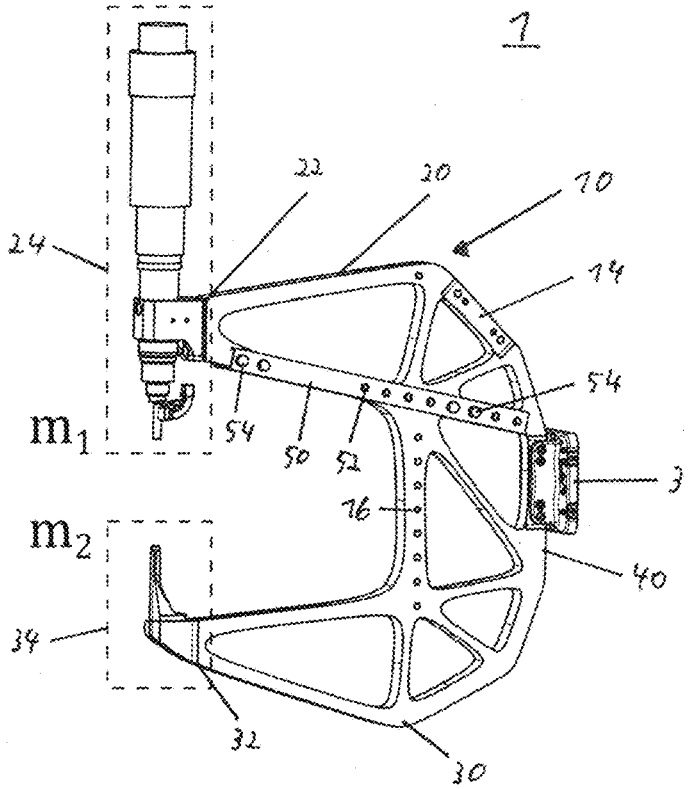

In order to solve this, FIG. 6 shows a first embodiment of a C-shaped tool holder 1. It comprises two compensating elements 50 which are releasably arranged by means of pins 54 at opposite sides of the first leg 20. For the fastening of the compensating elements 50 to the C-shaped tool holder 1 or the corresponding frame structure 10, respectively, all releasable kinds of connections which can be produced with hand-held tools are suitable. These may include screwing, pinning, clamping and clipping. For the sake of completeness, it is pointed out that the compensating element 50 does not necessarily have to extend in a straight manner but may also extend in a bent way, arc-shaped or curved manner.

In the illustrated example, the compensating element 50 consists of a U-shaped profile having ten openings 52. Two openings 52 are provided directly next to one another at a first axial end while the remaining eight openings 52 are provided at a distance to that and starting at the second axial end. Even if in the present example, two openings 52 are arranged next to one another at the first axial end, the use of one opening 52 each is sufficient for realizing the function. The frame structure 10 of the C-shaped tool holder 1 comprises corresponding openings 16. This is for example shown in FIG. 10.

The geometrical moments of inertia of the first 20 and the second leg 30 are normally not constant over the length of the first 20 and the second leg 30. By using the compensating element 50, the respective geometrical moment of inertia is, however, increased and the deflection is reduced by that until the first $G_1$ and the second straight line $G_2$ meet at the operating point so that the operating point and the intersecting point S coincide.

Figure 7:
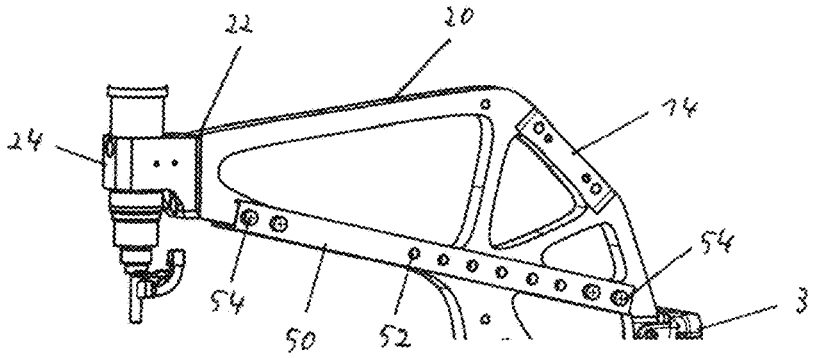

In FIG. 6, the pins 54 in the two openings 52 are arranged at the first axial end of the compensating element 50 as well as in the second to last pair from the row of eight openings 52, starting at the second axial end of the compensating element 50. Compared to that, the pins 54 in FIG. 7 are arranged in the last pair from the row of eight openings 52. In this regard, it is additionally emphasized that the use of two directly neighboring pins also reduces the danger of a bending up of the C-shaped tool holder 1 by process-caused acting forces during operation.

Figure 8:
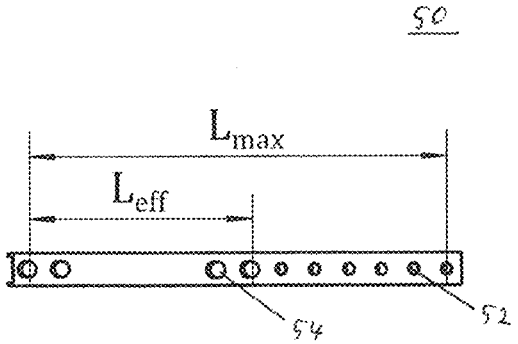

Beside the shape of the compensating element, the effect of the compensating element 50 is influenced by the position of the pins 54. This is explained with respect to FIG. 8.

Figure 13:
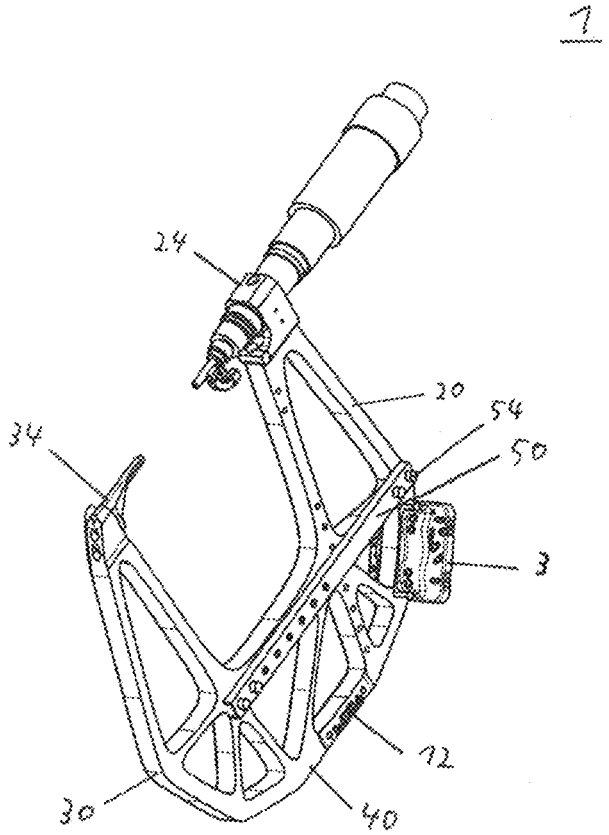

A maximal effective length $L_{max}$ of the compensating element 50 is thus determined by the distance of the openings 52 at the axial ends. The effective length $L_{eff}$ is determined by the distance of the two pins 54 that are furthest from one another. The minimum length, which should be chosen as the effective length $L_{eff}$, may correspond to at least one third of the cantilever $a_y$ of the first leg 20 in y-direction when using the central fastening portion 12, i.e. when using the central fastening portion 12, $L_{eff} \geq 1/3\ a_y$ applies. When using the upper fastening portion 14, the compensating element 50 may be arranged at the connecting piece 40, as is shown in FIG. 13. In this case, regarding the effective length $L_{eff}$, same corresponds to at least one fourth of the sum of the cantilever of the first leg 20 and the second leg 30 in x-direction, i.e. $L_{eff} \geq 1/4\ (a_x + b_x)$.

Figure 9:
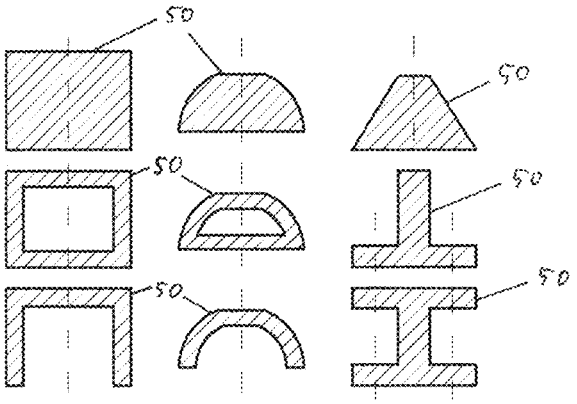

FIG. 9 shows cross-sectional views of the embodiments of the compensating element 50. In this case, this is, from top to bottom and from left to right, a full or solid rectangular, a hollow rectangular or box profile, a U-shape, a full or solid circular layer, a hollow circular layer, a hollow circular layer having an open bottom, a full or solid trapezoidal shape, a T-shape or a double T-shape. The term circular layer means cross-sectional shape which, analogously to a ball disc or ball layer, constitutes a part of a circle which is cut out from two parallel straight lines. Likewise, the use of an L-shape, a triangular, a massive or hollow semi-circle or the like is possible.

By doing so, the problems described at the beginning can be considered by suitably choosing the cross-sectional shape of the compensating element 50, because different geometrical moments of inertia offer a possibility of setting the centricity.

The compensating element 50 therefore may have a first axial geometrical moment of inertia and a second axial geometrical moment of inertia in cross section that is larger than the first axial geometrical moment of inertia. The at least one compensating element 50 is furthermore arranged so that the second axial geometrical moment of inertia acts perpendicularly to the frame plane R. With the axial geometrical moment of inertia, the cross-sectional dependency of the deflection of the at least one compensating element 50 under load is considered. In this context, the deflection of the at least one compensating element 50 is the smaller the bigger the axial geometrical moment of inertia is. For this reason, in the present embodiment, the at least one compensating element 50 may be arranged at the first leg 20 in a way that the gravity causes the smaller deflection. Thus, the bigger axial geometrical moment of inertia acts perpendicularly to the frame plane R. For the better comprehensibility, this is explained by means of a compensating element 50 that is rectangular in cross section. Same has a height h in cross section that is larger than its width b.

When this rectangular compensating element 50 is arranged at the first leg in a way that the height h extends parallel to the x-axis and the width b extends parallel to the z-axis, i.e. out of the frame plane, the axial geometrical moment of inertia of the compensating element 50 in case of a deflection around an axis parallel to the x-axis, i.e. in case of a gravity-induced deflection, is calculated as follows:

$$\frac{h \cdot b^3}{12}.$$

However, if the compensating element 50 is arranged at the first leg 20 in a way that the width b extends parallel to the x-axis and the height h extends parallel to the z-axis out of the frame plane, the axial geometrical moment of inertia in case of a deflection around an axis parallel to the x-axis, i.e. in case of a gravity-induced deflection, is calculated as follows:

$$\frac{b \cdot h^3}{12}.$$

As the height h is larger than the width b, only in the latter case does the larger axial geometrical moment of inertia act perpendicularly to the frame plane R. Thus, the compensating element 50 and its cross-sectional shape may be used effectively as in the first case, the larger geometrical moment of inertia acts in the frame plane R, namely in case of a deflection around an axis parallel to the z-axis.

The selected effective length $L_{eff}$ of the compensating element 50 as well as the assembly position offer further setting possibilities and depend on the weight forces and the respective lengths of the cantilevers measured from the binding, i.e. on top or centrally, to the point of force application, i.e. the drive end 22, 32.

Figure 10:
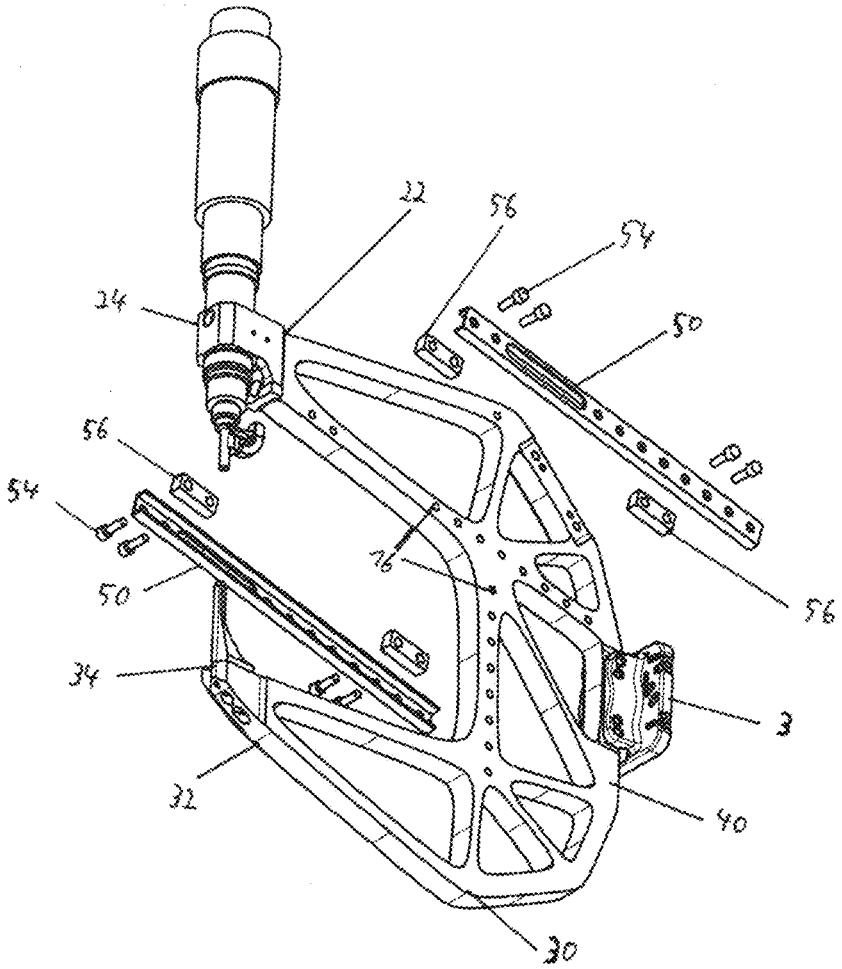

For a further optimization, FIG. 10 shows the additional use of slot nuts 56 which may be used with hollow or bowl profiles. They prevent a deformation as a result of a too high tightening or fastening torque when the compensating element 50 is fastened.

Figure 11:
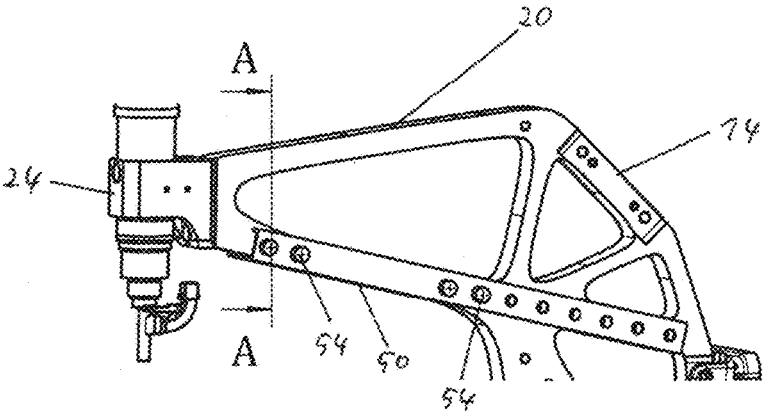
Figure 12:
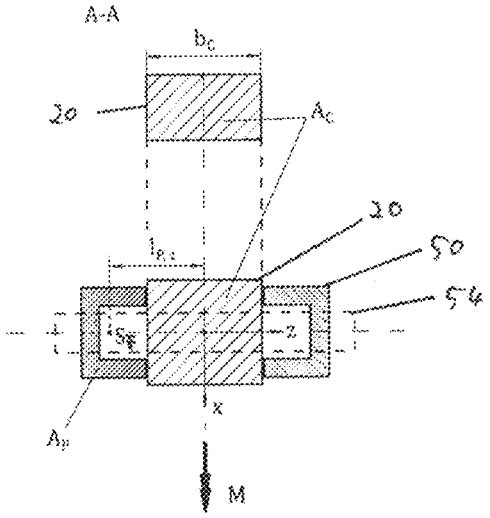

A further advantage of the use of the slot nuts 56 is discussed in the following because with the slot nuts 56, the distance of the compensating element 50 to the frame plane R of the C-shaped tool holder 1 can be varied. For this purpose, slot nuts 56 are used which have different extensions parallel to the z-axis, so that the Steiner proportion (parallel axis theorem) and thus the geometrical moment of inertia is increased. This is clarified in the following with reference to FIGS. 10-12, with FIG. 12 showing the cross section of the first leg 20 with two laterally attached compensating elements 50.

In the state of the art, stiffening elements such as profiles, springs and absorbers are installed symmetrically to the frame plane R in a C-shaped tool holder so as to minimize the operating force-induced bending open of the tool holder. For this purpose, exemplary reference is made to DE 10 2007 020 166 A1 that is discussed in the introductory part.

This approach is, however, not suitable for the gravity-induced deflection of the C-shaped tool holder 1 addressed in the present application, as for this purpose, the compensating elements 50 would have to be positioned laterally at the C-shaped tool holder 1 in order to counteract the gravity acting in the horizontal position transverse to the frame plane R.

This requirement becomes apparent when calculating the geometrical moment of inertia of the compensating element 50 with respect to the x-axis which lies in the frame plane R. The overall geometrical moment of inertia $I_{P,x,ges.}$ of the compensating element 50 increases by the Steiner proportion, i.e. by the distance of the centroid of the area $S_F$ of the compensating element 50 from the frame plane R in z-direction to the square multiplied with the cross-sectional surface of the compensating element $A_P$. This is illustrated in the following formula (4)

$$I_{P,x,ges.}=I_{P,x}+l_{P,z}^2\times A_P.$$

Here, $I_{P,x,ges.}$ constitutes the complete geometrical moment of inertia of the compensating element 50, $I_{P,x.}$ is the geometrical moment of inertia of the compensating element 50 with respect to or around the x-axis, $I_{P,z}$ is the distance of the centroid of the area $S_F$ of the compensating element 50 to the reference axis, i.e. to the x-axis and $A_P$ is the cross-sectional surface of the compensating element 50. For the purpose of completeness, the width $b_C$ of the first leg 20 as well as the cross-sectional surface $A_C$ of the upper leg 20 and the bending torque M around the x-axis is also drawn into FIG. 12.

The larger the distance to the frame plane R is chosen, the larger is the Steiner proportion. The following inequality according to formula (5) may be adhered to for a sufficient resistance against gravity:

$$l_{P,z}>0$$

which may be $$l_{P,z} > \frac{1}{2}b_C$$

and $$l_{P,z} > \frac{5}{8}b_C$$

When choosing the distance in z-direction, it should be considered for the purpose of completeness that the distance influences the arising interfering contour. Therefore, a middle course should be chosen.

FIG. 13 shows the attachment of a compensating element 50 when using the above fastening possibility 14 for the binding unit 3. Here, the compensating element 50 may be arranged along the connecting piece 40. The bending torque, that is the acting gravity multiplied with the cantilever, i.e. the distance between force application point and binding unit 3, is decisive for the alignment of the compensating element 50.

For the sake of completeness, it should be emphasized that a fastening of the fastening element(s) 50 may also take place at the outer edge surfaces or the inner edge surfaces of the C-shaped tool holder 1.

Figure 14:
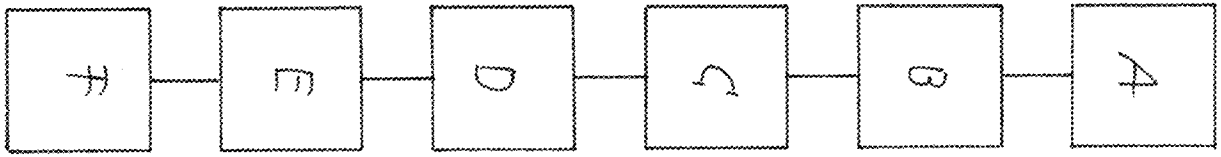

Now, with reference to FIG. 14, an embodiment of a method for setting an offset difference $\Delta_z$ between the first 20 and the second leg 30 of the C-shaped tool holder 1 is explained. In a first step A, an arranging of the C-shaped tool holder 1 takes place in a way that the frame plane R is aligned perpendicular to gravity. After that, a detecting of a first offset of the first leg 20 with regard to the frame plane R takes place in step B, and a detecting of a second offset of the second leg 30 with regard to the frame plane R takes place in step C. Steps B and C can be carried out subsequently or at the same time, with a sequence of step B and C being random.

As soon as the respective offset has been detected, at least one compensating element 50 is fastened to one or more of the first leg 20, the second leg 30 or the connecting piece 40 in step D. An offset difference $\Delta_z$ between the operating end 22 of the first leg 20 and the operating end 32 of the second leg 30 is minimized by that (step E).

In addition, a setting of a intersecting point S of a first straight line $G_1$ which corresponds to a movement direction of the punch in the direction of the operating end 32 of the second leg 30, and a second straight line $G_2$ which extends from the operating end 32 of the second leg 30 in the direction of the operating end 22 of the first leg 20, takes place in step F by the at least one compensating element 50 to an operating point.

The invention claimed is:

1. A C-shaped tool holder with a frame structure defining a frame plane comprising a) a first leg and a second leg that is arranged opposite to the first leg, each leg including a connecting end and an operating end, b) a connecting piece by means of which the first leg and the second leg are connected with each other at the respective connecting end, wherein c) the operating end of the first leg serves for fastening a punch with an associated drive unit defining a movement direction of the punch in the direction of the operating end of the second leg, and the operating end of the second leg serves for fastening a die dome wherein d) an offset difference due to a gravity-caused offset between the operating end of the first and the operating end of the second leg perpendicular to the frame plane can be minimized by at least one compensating element which is arranged at one or more of the following elements: the first leg, the second leg or the connecting piece, and e) an intersecting point of a first straight line corresponding to the movement direction of the punch in the direction of the operating end of the second leg, and a second straight line extending from the operating end of the second leg in the direction of the operating end of the first leg, is settable to an operating point by means of the at least one compensating element.

2. The C-shaped tool holder according to claim 1, wherein the at least one compensating element has in cross section a first axial geometrical moment of inertia and a second axial geometrical moment of inertia that is larger than the first axial geometrical moment of inertia, and the at least one compensating element is arranged so that the second axial geometrical moment of inertia acts perpendicularly to the frame plane.

3. The C-shaped tool holder according to claim 1, wherein the compensating element has a profile shape having one of the following shapes in cross section: rectangle, semi-circle, circular layer, triangle, T-shape, double-T-shape, L-shape, U-shape, trapezoid or a combination thereof.

4. The C-shaped tool holder according to claim 1, wherein the at least one compensating element includes at least two fastening points.

5. The C-shaped tool holder according to claim 1, wherein the compensating element has the shape of a hollow profile or bowl profile and furthermore, two slot nuts are present between the compensating element and the first leg, the second leg or the connecting piece.

6. The C-shaped tool holder according to claim 1, wherein the compensating element is releasably fastened to the corresponding one of the legs or the connecting piece.

7. The C-shaped tool holder according to claim 1 comprising two compensating elements.

8. The C-shaped tool holder according to claim 1 comprising a framework like frame structure.

9. The C-shaped tool holder according to claim 1 comprising at the operating end of the first leg a punch with an associated drive unit and at the operating end of the second leg a die dome.

10. A setting device with a C-shaped tool holder according to claim 1, wherein at the operating end of the first leg, a punch with an associated drive unit and at the operating end of the second leg, a die dome is fastened.

11. The setting device according to claim 10, wherein the setting device is fastened to a multi-axle robot by means of the C-shaped tool holder.

12. A method for setting an offset difference between a first and a second leg of a C-shaped tool holder according to claim 1, comprising the steps:

a. arranging the C-shaped tool holder in a way that a frame plane is aligned perpendicular to gravity, after that, b. determining a first offset of the first leg with respect to the frame plane and c. determining a second offset of the second leg with respect to the frame plane, after that, d. fastening at least one compensating element to one or more of the following: the first leg, the second leg or the connecting piece, and e. minimizing an offset difference between the operating end of the first and the operating end of the second leg.

13. The method according to claim 12, with the further step:

f. setting an intersecting point of a first straight line, which corresponds to a direction of movement of the punch in the direction of the operating end of the second leg, and of a second straight line, which extends from the operating end of the second leg in the direction of the operating end of the first leg, by means of the at least one compensating element to an operating point.

14. The method according to claim 12, wherein in cross section, the at least one compensating element comprises a first axial geometrical moment of inertia and a second axial geometrical moment of inertia that is bigger than the first axial geometrical moment of inertia, and the step of fastening takes place such that the compensating element is arranged in a way that the second axial geometrical moment of inertia acts perpendicularly to the frame plane.

15. The method according to claim 12, wherein the at least one compensating element is fastened via at least two fastening points to the first leg, the second leg or the connecting piece.

16. The method according to claim 12, wherein the at least one compensating element is releasably fastened to the first leg, the second leg or the connecting piece.

17. The method according to claim 12, wherein the at least one compensating element has the shape of a hollow profile or a bowl profile and at least two slot nuts are present between the compensating element and the first leg, the second leg or the connecting piece.

* * * * *